US007485833B2

(12) United States Patent
Lin

(10) Patent No.: US 7,485,833 B2
(45) Date of Patent: Feb. 3, 2009

(54) RARE EARTH ELEMENT CONTAINED SUBSTRATE FOR HEAT GENERATING DEVICE

(76) Inventor: Cheng Ping Lin, 5th Fl., No. 26, Sec. 3, Ren-ai Rd., Taipei (TW)

( * ) Notice: Subject to any disclaimer, the term of this patent is extended or adjusted under 35 U.S.C. 154(b) by 482 days.

(21) Appl. No.: 11/180,515

(22) Filed: Jul. 14, 2005

(65) Prior Publication Data

US 2007/0012682 A1 Jan. 18, 2007

(51) Int. Cl.
*H05B 3/10* (2006.01)

(52) U.S. Cl. ..... 219/548; 219/546; 219/222; 219/201; 219/200; 219/552; 219/553

(58) Field of Classification Search ..... 219/222, 219/200–201, 548, 552, 553
See application file for complete search history.

(56) References Cited

U.S. PATENT DOCUMENTS 3,610,888 A * 10/1971 Button ..... 219/543

* cited by examiner

*Primary Examiner*—Shawntina Fuqua
(74) *Attorney, Agent, or Firm*—Morris Manning Martin LLP; Tim Tingkang Xia, Esq.

(57) ABSTRACT

A rare earth element contained substrate for heat generating device contains the rare earth elements, compounds of the rare earth elements, or rare earth minerals so as to heighten its withstanding temperature and improve its heat dissipation. The substrate is also able to radiate a far infrared ray and yield negative ions for purifying the air.

1 Claim, 3 Drawing Sheets

RARE EARTH ELEMENT CONTAINED SUBSTRATE FOR HEAT GENERATING DEVICE

BACKGROUND OF THE INVENTION

1. Field of the Invention

The present invention relates to a rare earth element contained substrate, for a heat generating device, and more particularly, to a substrate for the heat generating device, where the substrate contains the rare earth elements, compounds of rare earth elements, or rare earth on minerals so as to heighten its withstanding temperature and improve its heat dissipation, and being capable of radiating a far infrared ray and yielding negative ions for purifying the air.

2.Description of the Prior Art

As it is well known, a conventional electrical heating device is usually made of a metallic wire, metallic bar, or metallic plate with substantially high resistance; sometime it is formed into a tubular heat generating device containing an electrical heater wire in it.

No matter what the heat generating element is made of a metallic wire (electrical heater wire) a metallic bar (electrical heater bar), a metallic plate (electrical heater plate), or an electrical heater tube, it has the following noticeable defects:

1. The heat generating device made of the aforesaid elements has several common disadvantages that it radiates a harmful electromagnetic wave, and produces useless light energy loss when carrying a current.
2. Being made of resistant material the aforesaid elements generate available heat when carrying a current. However, it is problematic as to how to precisely estimate the obtainable heat energy from a given element of a predetermined size such as length and cross section because all of the aforesaid heat generating elements have indefinite properties difficult to figure out.
3. With the unsolved problems discussed above, the conventional electrical heating devices are definitely not qualified for use in nowadays high technical electronic industry.

For improving the noticeable defeats on the prior art, the inventor has dedicated great efforts for years and has applied patents for invention or new models to the intellectual property office in Taiwan, for example: "Electrical Heater Film" (Taiwan Pat. App. No. 93114226) "Electrical Heater Film as Heating Device" (Taiwan Pat. App. No. 93214315), and "Uniform Temperature Heat Conducting Surface Board" (Taiwan Pat. App. No. 93215909).

In the above mentioned electrical heating devices the electrical heater film is made of semiconductor material and is fabricated according to the fabrication process of a semiconductor device. In order to avoid degrading the heat production efficiency, occurrence of an electric shock or radiation of harmful electromagnetic wave when carrying a current, the inventor has provided a ceramic substrate. Notwithstanding its excellent heat energy preservation effect, the ceramic substrate is fragile and frangible, and from a certain angle of view, it is noticeable for poor heat dissipation. The continuation of the research in this respect has finally brought up the inventor to come up with the present invention.

SUMMARY OF THE INVENTION

Accordingly, the main object of the present invention is to provide a heat generating device which can radiate far infrared ray good for health of the human body and yield negative ions for air purification.

The another object of the present invention is to provide a heat generating device whose strength of ceramic substrate can be enhanced to resist extraneous breaking force and assist to improve heat generating efficiency and heat dissipation effect.

To achieve the above objects, the heat generating device of the present invention uses a rare earth element contained ceramic substrate, where the rare earth elements come from adding material containing rare earth elements, their chemical compounds or minerals. The substrate contains no composition of $ABO_3$, wherein A, B and O represent a rare earth ion, a transition metal ion, and an oxygen ion, respectively. The substrate is formed into various shapes such as a flat plate, or a tubular shape. The substrate can be in the form of a porous substrate, or a net-like substrate.

For further understanding of the nature and objects of the invention, reference should be made to the fallowing detailed description taken in conjunction with the accompanying drawings showings below.

DETAILED DESCRIPTION OF THE PREFERRED EMBODIMENTS

In the present invention, the substrate of the heat generating device is made of high temperature with standing material containing the rare earth elements which are extracted from the mineral ores containing the rare earth elements.

Nowadays, there are more than ten rare earth elements discovered existing in the earth, namely, Tb, Ce, La, Pr, Nd, Sm, Eu, Gd, Yt, Dy, Ho, Be, Er, Lu, Sc, Ta, Tu, etc. They can be extracted from the minerals containing the same such as arthite, and others such as Ce—Si ore, P—Ce—La ore, Si—Be—Gd ore, Yt—Ta ore and phosphate ore. The substrate contains the family of the rare earth elements in the form of elements, compounds, or ores.

The ceramic substrate made of violet celestite has a high melting point as high as 1400° C., and its mechanical strength increases in proportion to the temperature up to 1200° C. so as to contribute to enhancing the stability of the heat generating device. Adding the rare earth elements into the substrate makes the heat generating device to have an excellent heat generating efficiency and better heat dissipation performance accompanying with a mechanically strong substrate. Moreover, its radiation of a far infrared ray and yielding negative ions when been heated contributes to functioning remote heating and purification of air.

EXAMPLE 1

Figure 1:
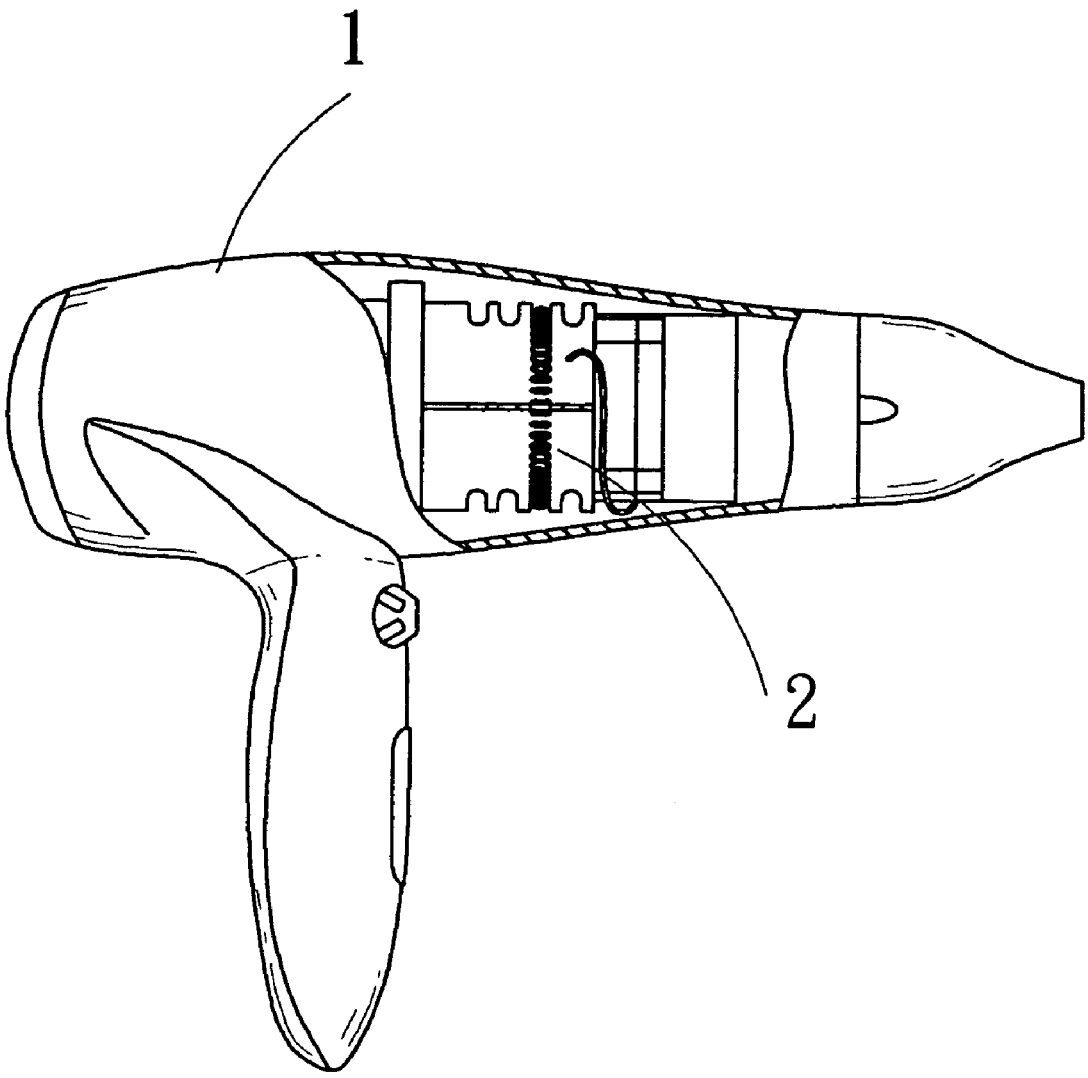
FIGS. 1, 2, 3*a* and 3*b* show respectively first to forth examples of the invention.

As shown in FIG. 1, the rare earth element contained substrate of the heat generating device according to the present invention is formed into a multi-layered substrate 2 accommodated in a hair dryer 1. The substrate 2 is a porous substrate, or a net-like substrate. When being heated, the far infrared ray radiated and the negative ions produced from the substrate 2 serve to quickly dry the hair and protect the hairs in a harmless condition.

EXAMPLE 2

Figure 2:
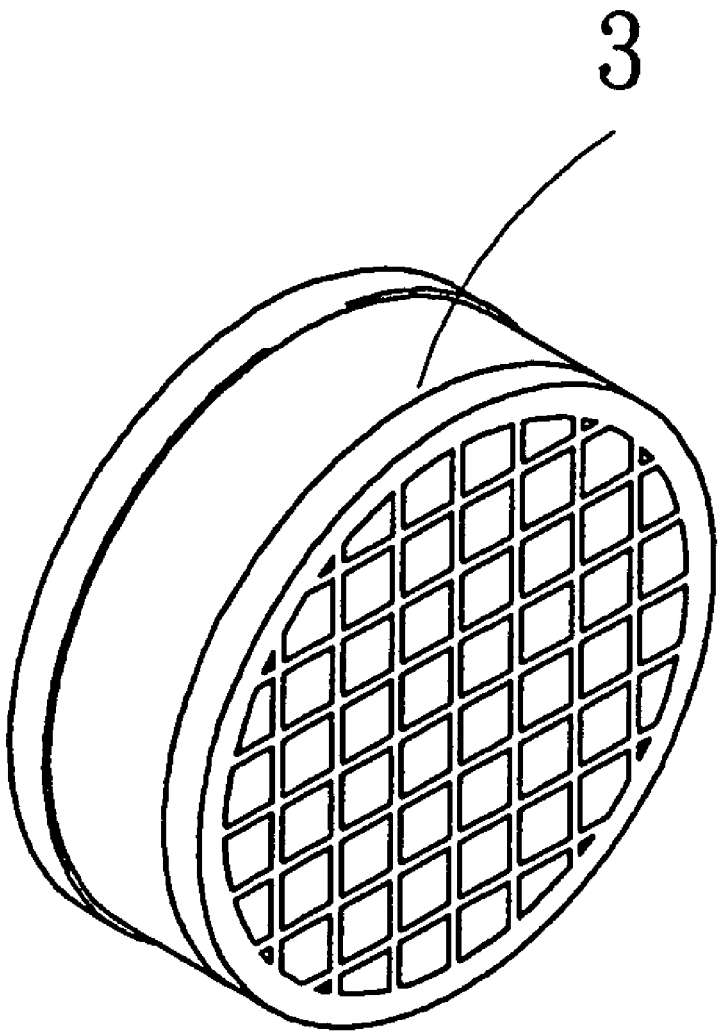

As shown in Fig 2, the rare earth element contained substrate of the present invention is incorporated with a cellular ceramic heat generating device 3. By so, the porosity of the heat generating device 3 assists the substrate to fully make use of its feature of the rare earth element material to enhance the heat generation and radiation of a far infrared ray effects.

EXAMPLE 3

Figure 3A:
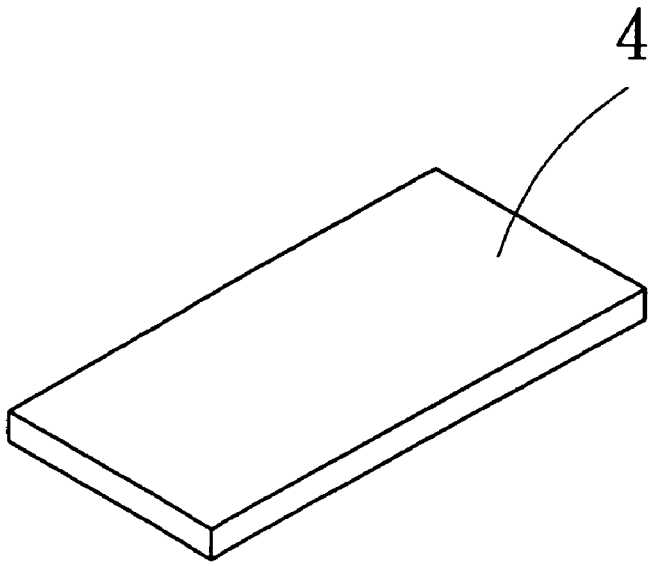
Figure 3B:
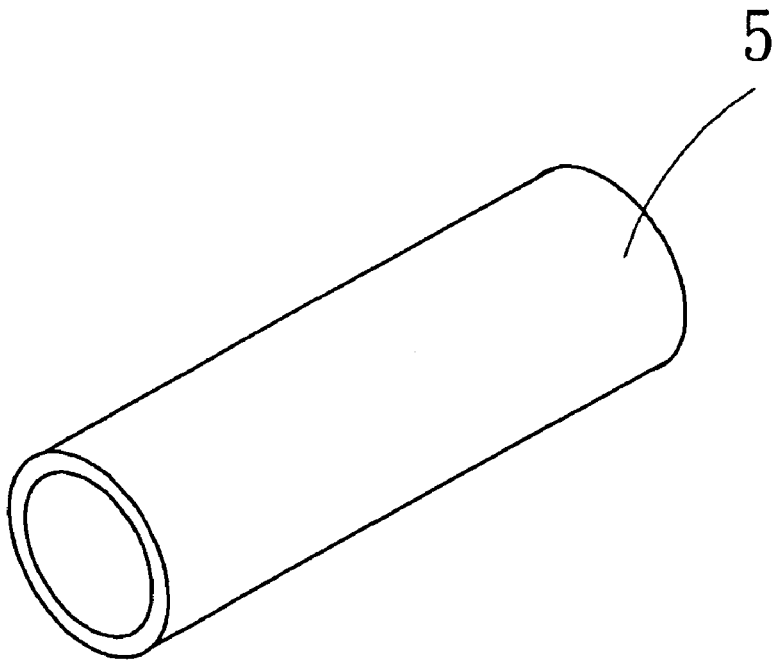

As shown in FIGS. 3*a* and 3*b*, the rare earth element contained substrate may be formed into various shapes of a flat plate 4, a circular tube 5, or others.

In all the heat generating device of the present invention has several noteworthy features attributed to its rare earth element contained substrate. The rare earth elements contained in the substrate not only serves to improve the mechanical strength of the substrate itself, but also contribute, to promote heat generation far infrared ray radiation, and yielding negative ions by the heat generating device.

It is understood that the present invention is a high level technical creation and by no means, simply utilizes conventional technology, or knowledge known prior to the application for patent, or can easily made by persons skilled in the arts. Prior to this application for patent, the invention has never been published, therefore present invention is entitled for applying patent.

Those who are skilled in the art will readily perceive how to modify the invention. Therefore the appended claims are to be construed to cover all equivalent structures which fall within the true scope and spirit of the invention.

What is claimed is:

1. A rare earth element contained substrate for heat generating device, comprising a ceramic substrate made of violet celestite having a melting point at about 1400° C., and a rare earth material such that its mechanical strength increases in proportion to the temperature up to 1200° C. so as to enhance the stability of the heat generating device, wherein said ceramic substrate is formed in a porous substrate, or a net-like substrate.

* * * * *